United States Patent [19]

Battegazzore

[11] Patent Number: 5,042,695

[45] Date of Patent: Aug. 27, 1991

[54] DISPENSER OF PASTE PRODUCTS HAVING A VENTING PISTON

[75] Inventor: Piero Battegazzore, Alessandria, Italy

[73] Assignee: Guala S.p.A., Alessandria, Italy

[21] Appl. No.: 356,253

[22] Filed: May 24, 1989

[30] Foreign Application Priority Data

Jun. 17, 1988 [IT] Italy ..... 21021 A/88

[51] Int. Cl.[5] ..... G01F 11/04; B67D 5/46

[52] U.S. Cl. ..... 222/259; 222/386

[58] Field of Search ..... 222/256, 257, 259, 260, 222/478, 481, 383, 386, 386.5, 389; 604/125; 92/182 P

[56] References Cited

U.S. PATENT DOCUMENTS 4,657,161 4/1987 Endo et al. ..... 222/383 X

FOREIGN PATENT DOCUMENTS 2139123 1/1979 Fed. Rep. of Germany ..... 222/386
3435576 4/1986 Fed. Rep. of Germany ... 222/386.5
2072755 10/1981 United Kingdom ..... 222/386

*Primary Examiner*—Andres Kashnikow
*Assistant Examiner*—Kenneth DeRosa
*Attorney, Agent, or Firm*—Notaro & Michalos

[57] ABSTRACT

A dispenser of paste products, in particular toothpaste, is composed of a cylindrical container provided with a headpiece carrying a paste product output and with a bottom wall fitting in an airtight manner therein for sliding movement one way toward the headpiece. The bottom wall consists of a plunger body having an axial cavity which is open downwardly and communicates, through radial passages, with the interior of the container, and of a dish-shaped body provided with a lug which fits snugly into the axial cavity. The outer surface of the lug on the dish-shaped body is provided with ribs which form, in co-operation with the inner wall of the axial cavity in the plunger body, channels extending along paths including at least one sharp change in direction. At the end of the container filling operation, the bottom wall is inserted and pushed against the toothpaste while trapped air is vented out through the channels. Once the air has been vented out, the flow of toothpaste which follows will stagnate inside the channels and seal them off, without flowing out of the container. Thus, the advantage is secured of having a bottom wall which automatically provides an airtight closure once the trapped air has been vented out.

8 Claims, 2 Drawing Sheets

DISPENSER OF PASTE PRODUCTS HAVING A VENTING PISTON

FIELD AND BACKGROUND OF THE INVENTION

This invention relates to a dispenser of generic paste products, and in particular toothpaste, being of a type which comprises a cylindrical container having a vertical longitudinal axis, a headpiece provided with an output means for the paste product and located at the top end of the container, and a bottom wall arranged to slide in a tight manner inside the container in one direction toward the headpiece.

A dispenser of the same kind as specified above is described, for example, in European Patent Application No. 86830205.0-2308.

More particularly, the invention is concerned with the construction of the bottom wall, which is designed to close the container and, consequently to the pumping action exerted through the paste output means, to move up toward the headpiece while restrained from moving back down, thereby being effective to reduce the container volume by a corresponding amount to the volume of the dispensed paste.

It is known that such dispenser types are filled with their output mechanisms mounted to the headpiece by introducing the paste product through the open bottom of the container.

This bottom is then closed by fitting in the sliding wall.

That operation poses some problems when carried out, including problems of a mechanical as well as hydraulic nature, because at the time of fitting in the bottom wall attention should be paid to whether any air is trapped in between the paste introduced into the container and the bottom wall. This air must be thoroughly removed.

It is, in fact, only in the total absence of air that the bottom wall can be made to intimately contact the paste all over and slide up the container by virtue of the pressure differential which is created at each dispensation between the outward side of the wall and the top of the column of paste inside the container.

After all the air has been vented out, however, the bottom wall is to both prevent the paste from seeping out and a fresh air cushion from forming, and therefore to provide an air-tight seal.

In accordance with a prior art approach, of which German Patent Application No. 3435576 is an example, the bottom wall is formed with an axial channel which opens both to the container inside and the outside, and a plug is pushed into the channel opening to shut it tightly after the container has been filled and trapped air vented out completely.

This prior approach apparently requires, however, that the bottom wall be pushed against the mass of toothpaste until the latter begins to overflow, in order to make sure that all the air has been removed and, accordingly, achieve an air-tight fit of the bottom wall.

In view of the characteristics of the automatic filling equipment employed, the detection of the exact moment when the air-tight fit can be correctly completed for the bottom wall involves a setup of checking arrangements and procedures which are bound to affect the product economy adversely.

SUMMARY OF THE INVENTION

The problem which underlies this invention is, therefore, to provide a bottom wall for dispensers of the kind specified above, which can be positioned within :he container, after filling the latter, and urged against the toothpaste to permit venting of the trapped air, but requires no checking step to signify that the air has been thoroughly vented out, and implies no need to arrange for and subsequently apply closure means to ensure its air-tightness.

This problem is solved, according to the invention, by a bottom wall for dispensers of the type specified above being characterized in that it comprises a plurality of channels one of the ends whereof opens to the container interior while the other end opens to the exterior of the container, such channels extending along paths which include at least one sharp change of direction and being provided each with a cross-section configuration such that the flow of paste therethrough, following the venting out of any air, will not reach the outside but stagnate instead within and seal off the channels.

BRIEF DESCRIPTION OF THE DRAWINGS

The invention will be now described with reference to a non-limitative embodiment thereof as illustrated in the accompanying drawings, where.

DESCRIPTION OF THE PREFERRED EMBODIMENT

Figure 1:
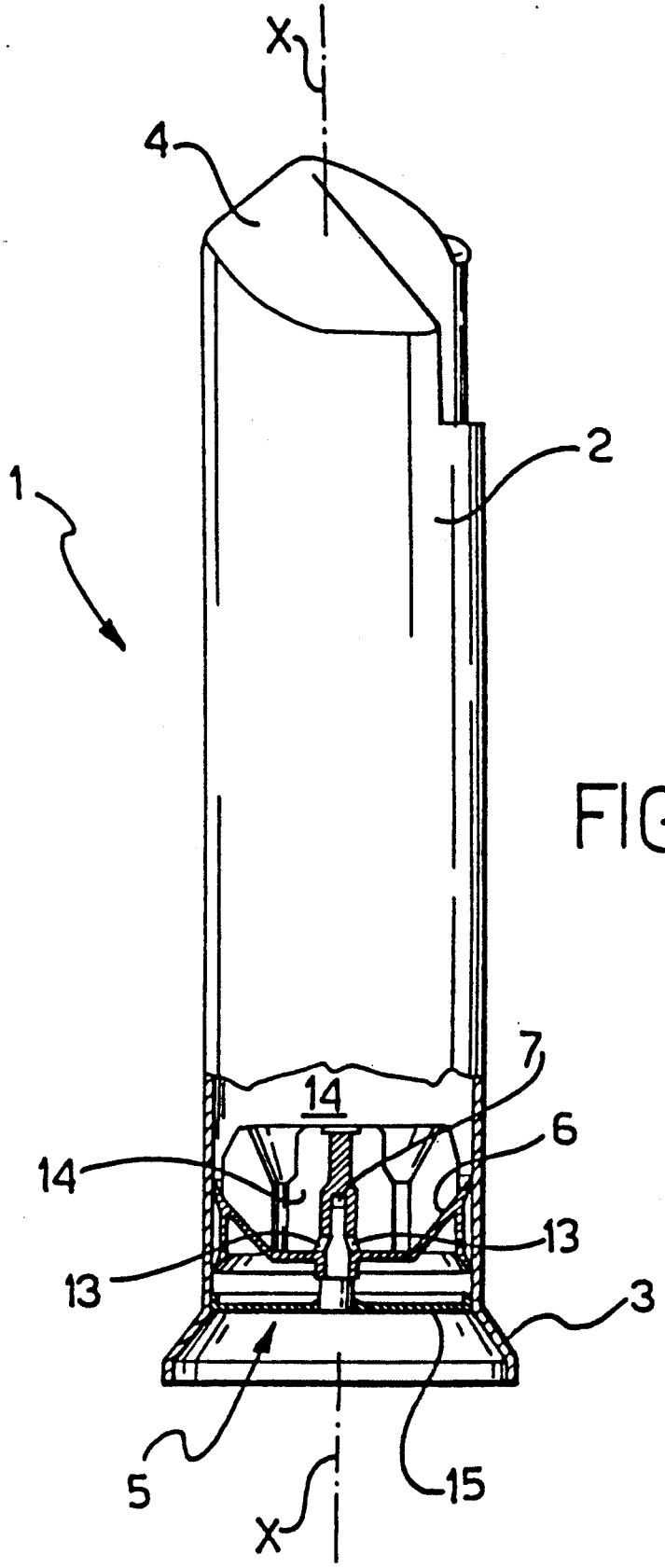
FIG. 1 is a part-sectional view showing in perspective a dispenser of paste products incorporating a bottom wall according to the invention.
Figure 2:
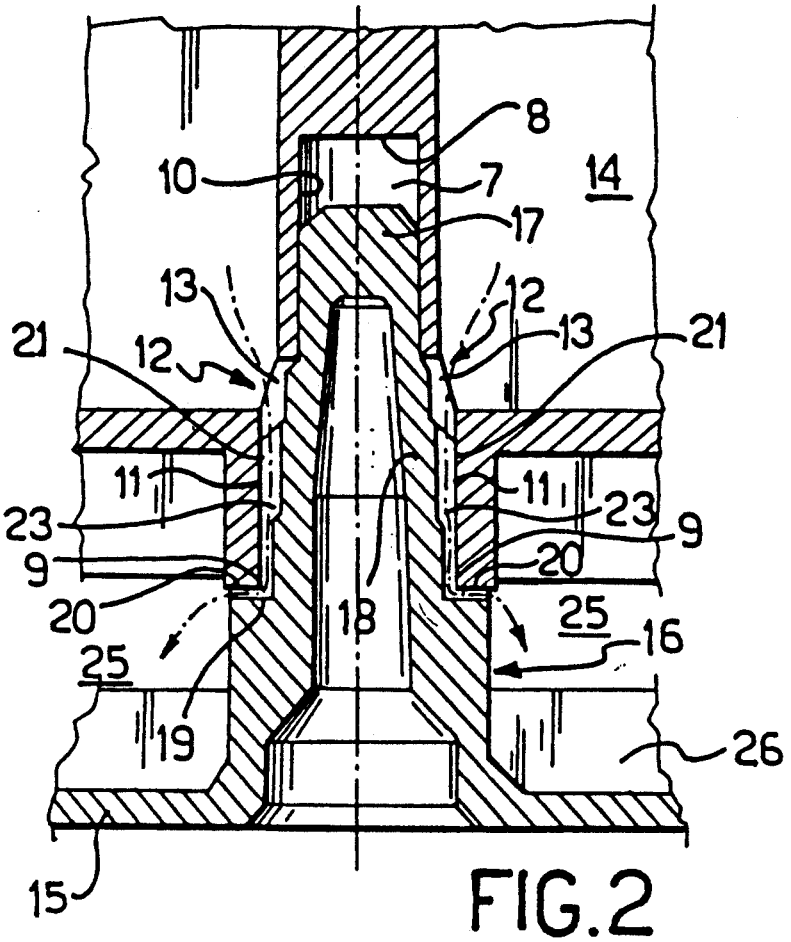
FIG. 2 is an enlarged scale detail view of the bottom wall according to the invention.

With reference to the drawing views, a dispenser 1 comprises a tubular cylinder container 2 having a vertical axis X-X and, located at its bottom end, an annular flange 3 facing outwards and forming a pedestal, with the top end of the container mounting a headpiece 4 which is provided with an output means, not shown, such as that described in European Patent Application No. 86830205.0-2308.

Fitted inside the cylindrical container 2, a bottom wall generally indicated at 5 is arranged to slide in an airtight manner one way from the pedestal 3 toward the headpiece 4 in consequence of the dispensation of paste product from the container 2.

That bottom wall 5 consists of a plunger body 6 which is formed with an axial hollow 7 having a circular cross-section and being closed at its end 8 facing the interior of the container 2 and open at the outward-facing end 9.

The axial hollow 7 structure is defined by a first cylindrical section 10 facing the closed end 8, a second section 11, also cylindrical, facing the open end 9, and a frusto-conical intermediate connection section 12 formed with radial apertures 13 which communicate the interior 14 of the container 2 with the axial hollow 7.

The bottom wall 5 further comprises a dish-shaped body 15 having a lug 16 which extends coaxially with the hollow 7 of the plunger body 6 into which it makes a push fit in a non-airtight manner for reasons and to provide features to become clear herein below.

More particularly, the lug 16 comprises a first cylindrical section 17 having such a diameter dimension as to make a push fit into said first section 10 of the axial hollow 7, a second cylindrical section generally indicated at 18 and formed with one or more diameters which are all smaller than the inside diameter of the section 11 of the hollow 7, and a radially-extending step 19 located in front of an annular rim 20 which surrounds the opening 9 of the axial hollow 7.

Figure 3:
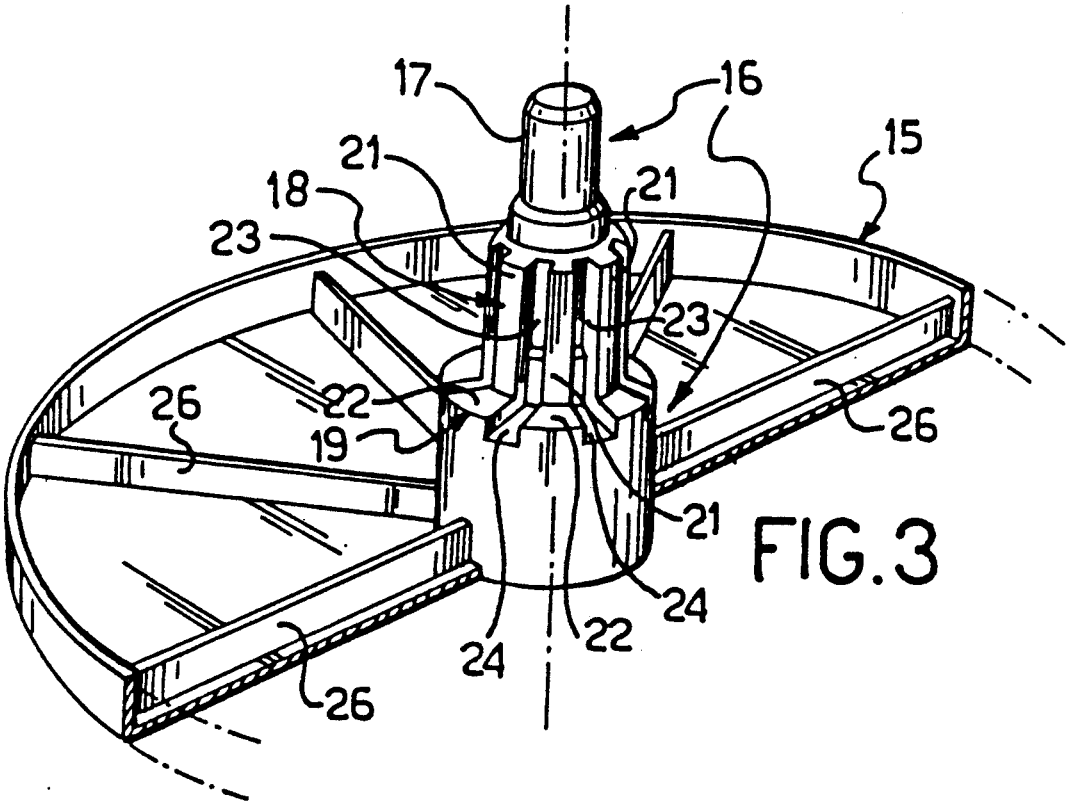
FIG. 3 is a perspective view of a dish-like body of the bottom wall.

In accordance with the invention, and with reference in particular to FIG. 3, the section 18 of the lug 16 is provided with a plurality of spaced-apart ribs 21 which extend radially for a distance selected to cause their ends to engage forcibly with the inner wall of the section 11 of the hollow 7.

The step 19 of the lug 16 is also provided with radial ribs 22 at such mutual spacings as to form extensions of the ribs 21.

Such radial ribs 22 extend axially to snugly abut with their free ends against the flat surface of the annular rim 20 which surrounds the opening 9 of the axial hollow 7.

Accordingly, between the ribs 21 and the opposedly located surface of the hollow 7 there are formed axial channels 23 which are extended radially with a sharp change of direction into an equal number of channels 24 formed between the ribs 22 and the opposed surface of the annular rim 20.

The cross-section of each channel is selected to suit the viscosity of the paste product filling the container 2. For example, with viscosities within the range of 25,000 to 75,000 mPa sec, the minimum cross-sectional area of each channel 23 and 24 would be about 0.05 $mm^2$.

The set of channels 23 and 24 are communicated, at one end, with the interior of the container 2 through radial apertures 13, and at the other end as indicated by arrows, with the outside environment through the interspace 25 left between the plunger body 6 and the dish-shaped body 15 stiffened by radial rib formations 26.

It may be appreciated from the foregoing description that, with the bottom wall, as consisting of the pre-assembled plunger body 6 and dish-shaped body 15 combination, fitted into the container 2 and being conventionally pushed by the packaging machine against a paste product previously loaded into the container, air trapped during the filling operation would be vented out through the apertures 13 and the channels 23 and 24.

As the push force continues to be applied, upon cessation of the outflow of air, the apertures 13 and at least the initial sections of the channels 23 are flooded with the paste product.

As a result of the cross-sectional areas of the channels 23 and 24, of their overall length, and of the sharp change in direction undergone by the flow between the channels 23 and 24, which factors would depend on the viscosity of the paste product to be dispensed, the paste product will flow outwards, but in stagnating and setting inside the channels 23 and 24, automatically seals off the bottom wall, thereby securing the results and advantages set forth for the invention, and this in particular without the need for checking provisions on the filling/packaging machine to sense completion of the trapped air venting and hence control the bottom wall to close in an airtight manner.

I claim:

1. A dispenser of paste products, in particular, toothpaste, comprising a cylindrical container having a vertical longitudinal axis, a headpiece provided with an output means for the paste product and located at the top end of the container, a bottom wall arranged to slide in a tight manner and as one structural piece inside the container in one direction toward the headpiece, a plurality of channels in said bottom wall, one end of each channel opening to the inner side of the container and said end of each channel having a cross-section configuration allowing a flow of paste therethrough, and the other end of each channel opening to the outside of the container, said channels extending along paths which include at least one sharp change of direction and being provided each with a cross-section configuration such that the flow of paste there-through, following a venting out of any air, will not reach the outside but will stagnate instead within and seal off the channels.

2. A dispenser according to claim 1, wherein an axial cavity is defined in said bottom wall by a first cylindrical section adjoining said closed end, a second cylindrical section having a larger diameter than the first section and adjoining said open end, and a frusto-conical intermediate connection section formed with said radial apertures.

3. A dispenser according to claim 1, wherein said bottom wall comprises a plunger body having an axial cavity with a closed end facing the inner side of the container and an open end at an opposite axial location, said cavity being formed with radial apertures open to the inner side of the container, the bottom wall including a dish-shaped body provided with a lug extending coaxially with and fixed in the cavity in the plunger body from the open end of the cavity, said channels being defined between said lug and said plunger body with the other end of each channel opening into a space between said plunger and said dish-shaped body.

4. A dispenser according to claim 3, wherein said open end of the axial cavity is provided with an annular rim.

5. A dispenser according to claim 3, wherein said axial cavity is defied by a first cylindrical section adjoining said closed end, a second cylindrical section having a larger diameter than the first section and adjoining said open end, and a frusto-conical intermediate connection section formed with said radial apertures.

6. A dispenser according to claim 3 wherein said axial cavity is defined by a first cylindrical section adjoining said closed end, by a second cylindrical section having a larger diameter than the first section and adjoining said open end, by a frusto-conical intermediate connection section formed with said radial apertures, said open end of the axial cavity being provided with an annular rim, and wherein the lug on said dish-shaped body comprises a first cylindrical section having a diameter dimension whereby it fits snugly within said first section of said axial cavity, a second cylindrical section having a smaller diameter than said second section and a radially extending step located in front of said annular rim of the open end of the axial cavity.

7. A dispenser according to claim 6, wherein the outer surface of said second cylindrical section of the lug on the dish-shaped body is formed with a plurality of axial ribs projecting radially out at mutually spaced-apart locations, the free ends of said ribs engaging forcibly with the cylindrical inner wall of a corresponding section of the axial cavity to form a plurality of intermediate axial channels one end whereof is in communication with said radial apertures provided in the frusto-conical intermediate section of the axial cavity.

8. A dispenser according to claim 6, wherein said radially extending step of the lug on the dish-shaped body is formed with a plurality of radial ribs mutually spaced apart from one another and projecting in the axial direction, the free ends of said ribs face abutting against the surface of said annular rim on the open end of the axial cavity to form intermediate radial channels communicating, at one end, with said intermediate axial channels, and at the other end, with the outside of the container.

* * * * *